United States Patent [19]

Hook et al.

[11] 4,080,819

[45] Mar. 28, 1978

[54] APPARATUS FOR MAKING DRAWN ARTICLES

[75] Inventors: Bernard K. Hook, Hastings; Richard J. Heniser, Grand Rapids; Stanley J. Miller, Hastings, all of Mich.

[73] Assignee: Gulf & Western Manufacturing Company, Southfield, Mich.

[21] Appl. No.: 745,291

[22] Filed: Nov. 26, 1976

[51] Int. Cl.[2] ..... B21D 22/00

[52] U.S. Cl. ..... 72/347; 72/336

[58] Field of Search ..... 72/336, 347, 348, 349, 72/350, 456; 113/1 G, 7 R, 120 H

[56] References Cited

U.S. PATENT DOCUMENTS

| | | | |
|---|---|---|---|
| 1,999,386 | 4/1935 | Arnold | 72/300 X |
| 2,345,353 | 3/1944 | Misfeldt | 72/347 |
| 2,411,503 | 11/1946 | Colleson et al. | 72/336 X |
| 2,547,331 | 4/1951 | Lent | 72/350 X |
| 3,147,722 | 9/1964 | Williamson | 72/350 X |
| 3,453,848 | 7/1969 | Williamson | 72/349 X |

*Primary Examiner*—Leon Gilden

*Attorney, Agent, or Firm*—Meyer, Tilberry & Body

[57] ABSTRACT

Press mounted apparatus is disclosed for shearing a blank from a metal sheet and for drawing the blank to a cup-shaped configuration. The apparatus includes a fixed annular drawing die mounted on the press bed and having a drawing surface extending radially from the die opening and terminating in a circular cutting edge, and a movable tool assembly mounted on the press slide and including a draw pad and a cutter member. The draw pad is mounted on the slide for reciprocating movement relative thereto and to the cutter member. The cutter member is cooperable with the cutting edge on the fixed die to sever a blank from a sheet of material therebetween, and the draw pad has a drawing surface opposite the drawing surface of the fixed die. The two drawing surfaces engage opposite sides of the blank, and the drawing surfaces are spaced apart a predetermined distance related to the thickness of the sheet material by opposed pins carried respectively by the draw pad and fixed tool assembly. The draw clearance between the drawing surfaces varies in accordance with the thickness of the sheet material.

17 Claims, 4 Drawing Figures

APPARATUS FOR MAKING DRAWN ARTICLES

This invention relates to the art of metal drawing apparatus and, more particularly, to an improved tool assembly for shearing a blank from a metal sheet and drawing the blank to a cup-shaped configuration.

In the manufacture of drawn and ironed metal can bodies having a cylindrical sidewall and an integral bottom wall, such can bodies are generally formed by drawing and ironing shallow cup-shaped metal can body blanks. The cup-shaped can body blanks are formed by severing circular blanks from a flat metal sheet and drawing the blanks to the cup-shaped configuration in a suitable metalworking press. Generally, a continuous metal sheet from a roll, or indidivual metal sheets, are fed through the press and a plurality of circular blanks are severed from the sheet and drawn to the cup-shaped configuration during each stroke of the press. Such continuous production and a high rate of output of cup-shaped can body blanks is essential to meet the supply demands for drawn metal can bodies.

In connection with the production of cup-shaped can body blanks, the drawing operation involves severe reductions in metal thickness and requires extremely accurate tooling and die clearances in order to obtain the necessary accuracy with regard to thickness of the sidewall of the cup-shaped can body blank. Additionally, high speed production requires a high drawing ram speed. These requirements promote friction between the die components, ram and metal blank during the drawing operation and thus an undesirable heat build up. Further, variations in the thickness of the metal sheet fed to the press can increase friction and/or heat build up when, for example, the metal thickness is greater than that for which the tooling assembly clearances are designed. Still further, such variations in sheet metal thickness can impose undesirable forces on the components of the tool assembly and decrease the life and efficiency thereof as a result of undue wear, whereby maintenance and replacement costs become undesirably high.

In apparatus heretofore provided for forming cup-shaped metal can body blanks from sheet material, a circular blank is cut from a metal sheet and is held between opposed drawing surfaces of a die assembly during movement of a ram through a circular die to form the circular blank into a cup-shaped configuration. During the drawing operation, the peripheral edge of the circular blank is displaced radially inwardly from between the drawing surfaces. It has been proposed heretofore, in an effort to reduce friction and promote high speed production, to control the spacing between the opposed drawing surfaces in accordance with the thickness of the metal sheet. This has been achieved through tooling assemblies including a fixed drawing die block and cutting edge on the press bed and an integral draw pad and cutting edge mounted on the press slide. The two cutting edges are cooperable to sever a circular blank from a sheet therebetween, and the die block and draw pad engage opposite sides of the metal sheet to relatively position the die block and draw pad in accordance with the sheet thickness. To compensate for variations in thickness, the draw pad and the integral cutting edge thereon are reciprocable relative to the press slide and are biased against such reciprocation. Accordingly, when the die block and draw pad engage opposite sides of the metal sheet, a sheet thickness greater than that for which the tool assembly is designed causes reciprocation of the draw pad and corresponding cutting edge relative to the slide. Thus, spacing between the drawing surfaces of the die block and draw pad varies in accordance with the sheet thickness.

While an arrangement of the foregoing character is operable to provide for the clearance between the drawing surfaces to vary in accordance with variations in the sheet metal thickness, there are structural and functional disadvantages which promote undesirable wear and force transmission between the component parts of the tool assembly, undesirably high maintenance and replacement costs, and inability to achieve a desirable high speed press operation, whereby an optimum production rate is not obtainable. More particularly in this respect, the integral relationship between the draw pad and corresponding cutting edge, and the biased mounting thereof for reciprocation relative to the press slide, causes the cutting forces encountered during severing of the sheet material to be imposed on the components of the biasing arrangement. Such a force imposition can cause bouncing and/or vibration of the cutting edge and thus the drawing surface of the draw pad which is integral therewith, especially under high speed slide movement. Accordingly, slide speed must be reduced to avoid this condition and/or an extremely high biasing force must be applied in biasing the draw pad components. In this respect, it will be appreciated that the severing, holding and drawing steps are sequential and yet almost simultaneous in time, whereby vibration or bouncing of the drawing surface of the draw pad relative to the die block can result in an uneven application of holding force on the peripheral edge of the severed blank as the ram moves through the die cavity. Accordingly, accuracy is decreased with respect to the drawing operation and control of the wall thickness of the drawn can body blank. Further, vibration and/or bouncing of the cutting edge as a result of its integral relationship with the biased draw pad decreases the ability to achieve a clean cut of the blank from the sheet material and promotes wear of the cutting edge, thus decreasing the life thereof. This not only effects the resulting edge at the open end of the drawn can body blank but increases down time of the press for maintenance or replacement with respect to the cutting edge, whereby production rate is reduced. Additionally, replacement of the cutting edge necessarily requires replacement of the draw pad which is integral therewith. This disadvantageously increases replacement costs in view of the fact that the draw pad is not a component requiring maintenance or replacement as often as the cutting element. The extent of such bouncing and/or vibration, the effect thereof on the drawing operation, and the rate of wear of component parts resulting therefrom will be appreciated when it is considered that, in connection with a desired high production rate, the press is preferably operated at a rate of from 90 to 125 strokes per minute. Accordingly, it becomes desirable to provide a tool assembly enabling achievement of the desired spacing of the drawing surfaces and, at the same time, enabling the desired production rate by eliminating or minimizing the undesirble force application, bouncing and/or vibration, and the resulting drawing inaccuracies and component part wear which has heretofore necessitated slower press speeds and thus a lower production rate per tool in a given press.

In accordance with the present invention, an improved tool assembly is provided by which a blank is cut from a metal sheet and then drawn to a cup-shaped configuration. Further, the drawing surfaces engaging opposite sides of the blank are maintained spaced apart a distance dependent upon the thickness of the metal sheet from which the blank is cut, and cutting forces are transmitted through the tool assembly independent of the draw pad. Accordingly, bouncing and/or vibration is minimized, as are inaccuracies in the drawing operation, wear of component parts of the assembly, and maintenance and replacement costs.

More particularly in accordance with the present invention, the foregoing capabilities and advantages are achieved by providing for the draw pad component of the tool assembly and the corresponding cutting edge to be structurally independent of one another, and for the draw pad to be reciprocable relative to the cutting edge. The draw pad and corresponding cutting edge have a common support, and the cutting edge is fixed against displacement relative thereto. The draw pad is reciprocable relative to the support and is biased against such reciprocation. This enables the drawing surface of the draw pad to be spaced from the drawing surface associated with the drawing die member in accordance with the thickness of the metal sheet from which the blank is cut. This arrangement further advantageously provides for the cutting force encountered to be transmitted through the cutting edge directly to the support, whereby there is no bouncing and/or vibration imparted to the draw pad through the cutting edge. Thus, the holding force of the die surfaces relative to the sheet material is more uniform during the drawing operation. Additionally, the rigidity of the cutting edge relative to the support promotes a cleaner cut of the sheet material and a reduction of wear of the cutting edge.

The elimination or minimizing of bounce and/or vibration of the draw pad and the resulting uniform holding force increases accuracy of the drawing operation, especially with regard to controlling wall thickness of the drawn cup-shaped article, and reduces component wear. Addtionally, the separate relationship between the cutting edge and draw pad advantageously enables maintenance and/or replacement of the cutting edge independent of the expense of simultaneous replacement of the draw pad. All of these advantages enable a higher stroke per minute operation of the press than heretofore possible, less down time for maintenance and replacement purposes and, accordingly, a high output or production rate without sacrificing quality and accuracy with regard to the can body blank produced.

It is accordingly an outstanding object of the present invention to provide an improved tool assembly for severing and drawing a cup-shaped article from a metal sheet.

Another object is the provision of a tool assembly of the foregoing character which enables spacing of opposed drawing surfaces to be achieved in accordance with the thickness of the metal sheet from which the blank is severed and with a uniform holding force on the sheet between the drawing surfaces.

A further object is the provision of a tool assembly of the foregoing character in which the cutting and drawing components are structurally interrelated to minimize undesirable vibration, force transmission and wear during operation of the tool assembly.

Yet another object is the provision of a tool assembly of the foregoing character which enables clean cutting of the blank and accuracy with respect to drawing parameters while maintaining an optimum production rate.

Still a further object is the provision of a tool assembly of the foregoing character which enables a more accurate and efficient production of a cup-shaped metal can body blank than heretofore possible and a higher production rate per tool assembly.

Yet another object is the provision of an improved tool assembly for a can body blank forming press and by which tool assembly a circular blank is cut from a metal sheet and held between drawing surfaces including that of a reciprocable draw pad, and wherein displacement of the draw pad is independent of any cutting forces imposed on the tool assembly during the cutting operation.

The foregoing objects, and others, will in part be obvious and in part pointed out more fully hereinafter in conjunction with the following written description of a preferred embodiment of the invention shown in the accompanying drawings in which.

Figure 1:
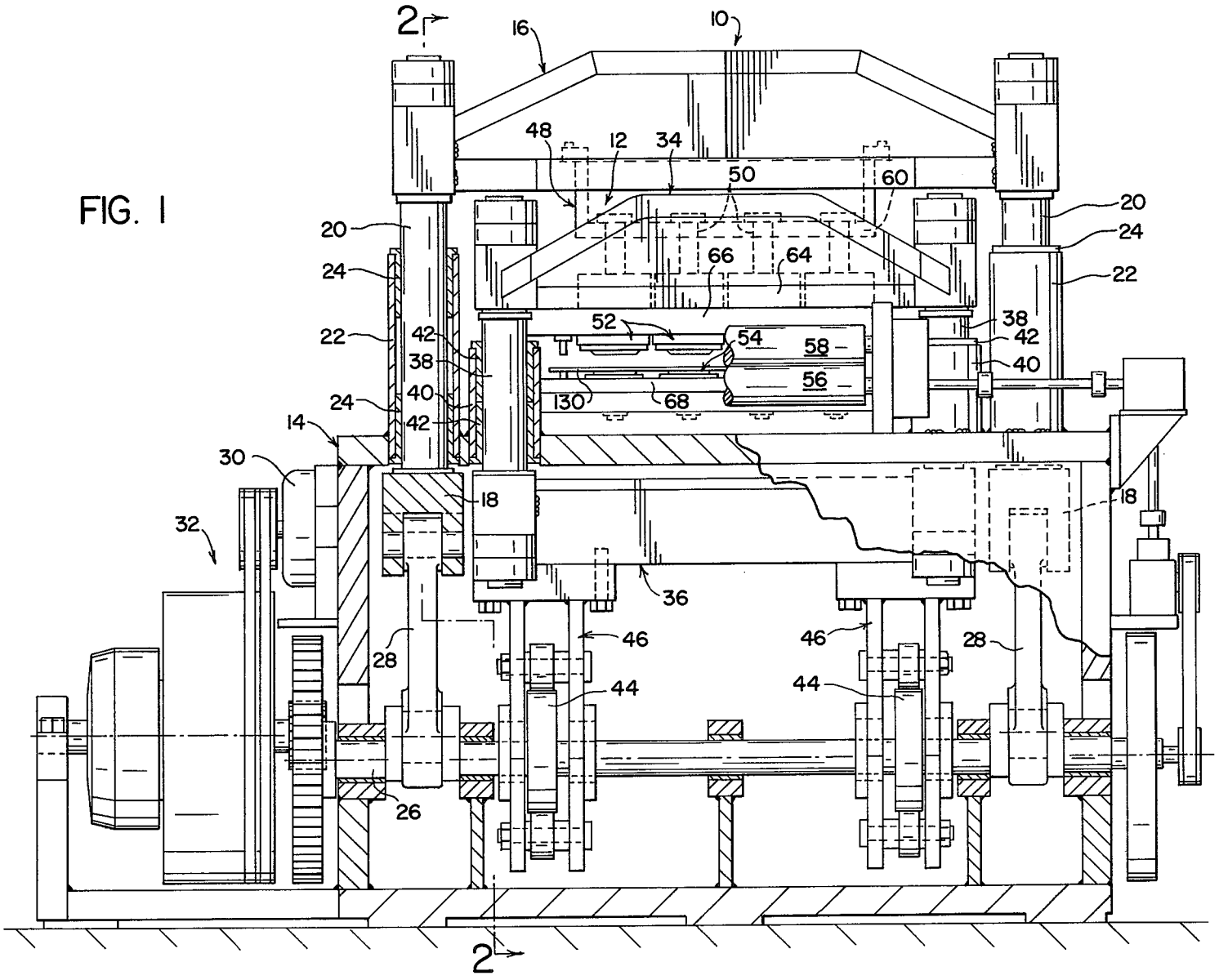
FIG. 1 is an elevation view, partially in section, of a press including cutting and drawing tool assemblies in accordance with the present invention.
Figure 2:
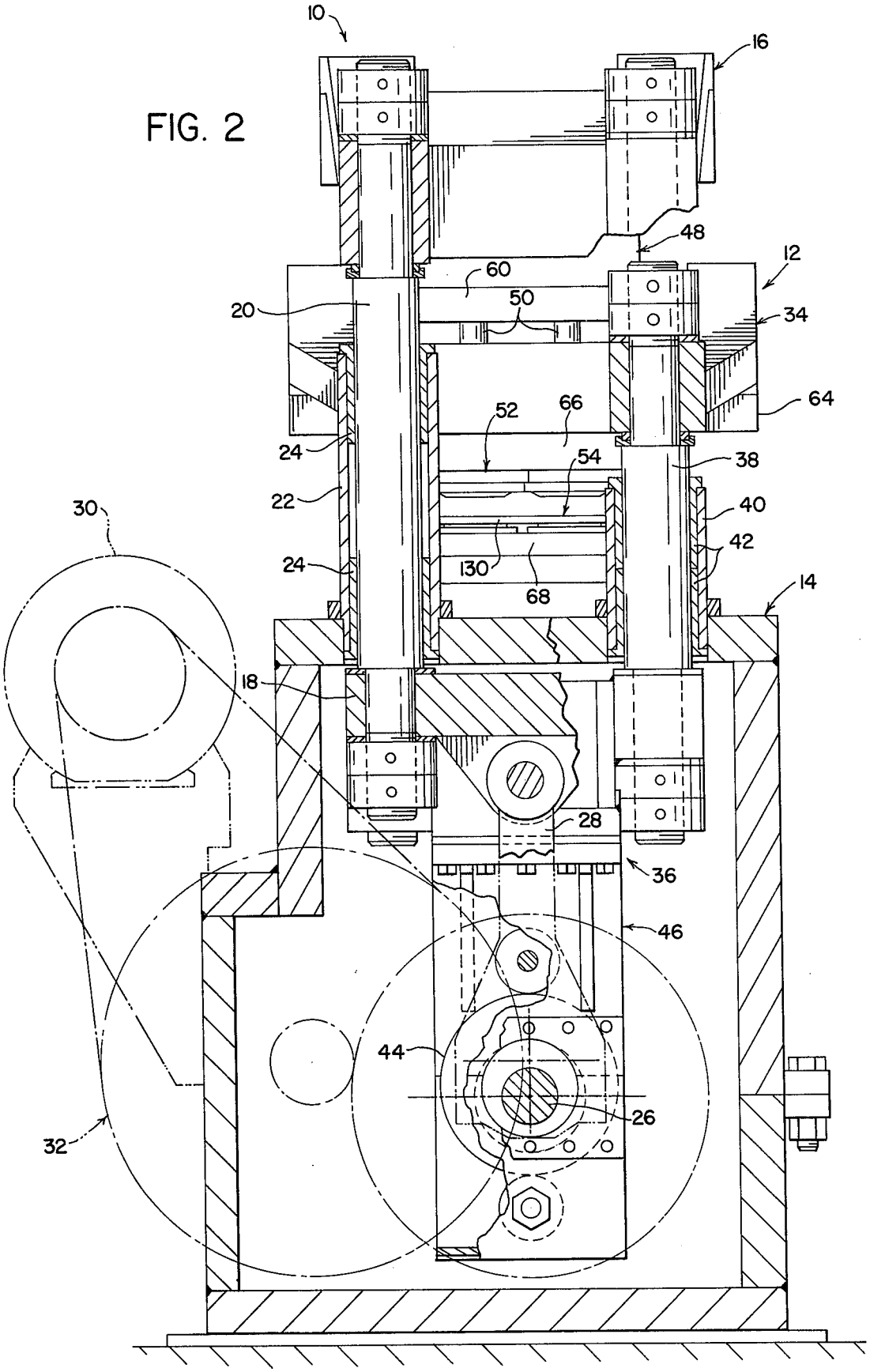
FIG. 2 is a sectional elevation view of the press and tool assemblies taken along line 2—2 in FIG. 1.

Referring now in greater detail to the drawings wherein the showings are for the purpose of illustrating a preferred embodiment of the invention only and not for the purpose of limiting the invention, a double action press is shown in FIGS. 1 and 2 which includes a frame structure supporting a punch slide 10 and a blanking slide 12 for vertical reciprocation relative to one another and relative to a bolster plate 14 which forms part of the press frame. Punch slide 10 includes an upper punch slide frame 16 and a lower punch slide frame 18 disposed beneath bolster plate 14. Punch slide frames 16 and 18 are interconnected by four guide rods 20 slidably received in corresponding guide sleeves 22. The lower ends of guide sleeves 22 are suitably mounted in openings in bolster plate 14, and bushings 24 are interposed between each guide sleeve 22 and the corresponding guide rod 20.

The press frame supports a crankshaft 26, and connecting rods 28 have their opposite ends pivotally interconnected one with crankshaft 26 and the other with lower punch slide frame 18 such that rotation of the crankshaft reciprocates punch slide 10 relative to bolster plate 14. Crankshaft 26 is rotated by a motor 30 mounted on the press frame and through a drive train designated generally by the numeral 32.

Blanking slide 12 includes an upper blanking slide frame 34 and a lower blanking slide frame 36 disposed beneath bolster plate 14 and within lower punch slide frame 18. Blanking slide frames 34 and 36 are interconnected by four guide rods 38 each slidably received in a corresponding guide sleeve 40 mounted on bolster plate 14. Bushings 42 are interposed between sleeve 40 and the corresponding guide rod 38. Crankshaft 26 is provided with a pair of cams 44, and lower blanking slide frame 36 is provided with corresponding roller bracket assemblies 46. Each bracket assembly 46 is cooperable with the corresponding cam 44 to reciprocate blanking slide 12 in response to rotation of crankshaft 26.

Upper frame 16 of punch slide 10 includes a punch stem bracket 48 on which a plurality of drawing punches 50 are mounted for reciprocating movement with punch slide 10. Upper frame 34 of blanking slide 12 carries a corresponding pluralty of upper blank cutting and holding assemblies 52, described in detail hereinafter, and which are accordingly reciprocable with blanking slide 12. Bolster plate 14 supports a plurality of lower blank cutting and holding assemblies 54, described in detail hereinafter, and each of which underlies and is cooperable with one of the upper assemblies 52 and the corresponding punch 50. Sheet metal to be cut and drawn is fed between blank cutting and holding assemblies 52 and 54 by a pair of feed rollers 56 and 58 which are suitably driven in coordination with reciprocation of slides 10 and 12. When the metal sheet is positioned between cutting and holding assemblies 52 and 54, blanking slide 12 moves toward bolster plate 14 for the assemblies 52 and 54 to cooperate as set forth hereinafter to cut a circular blank from the metal sheet and to hold the blank during movement of punch slide 10 and thus punch 50 toward bolster plate 14 to form the blank to a desired drawn configuration. It will be appreciated that the several cutting and forming units comprising punches 50 and corresponding assemblies 52 and 54 are identical and that the following description of one such unit is applicable to the others.

Figure 3:
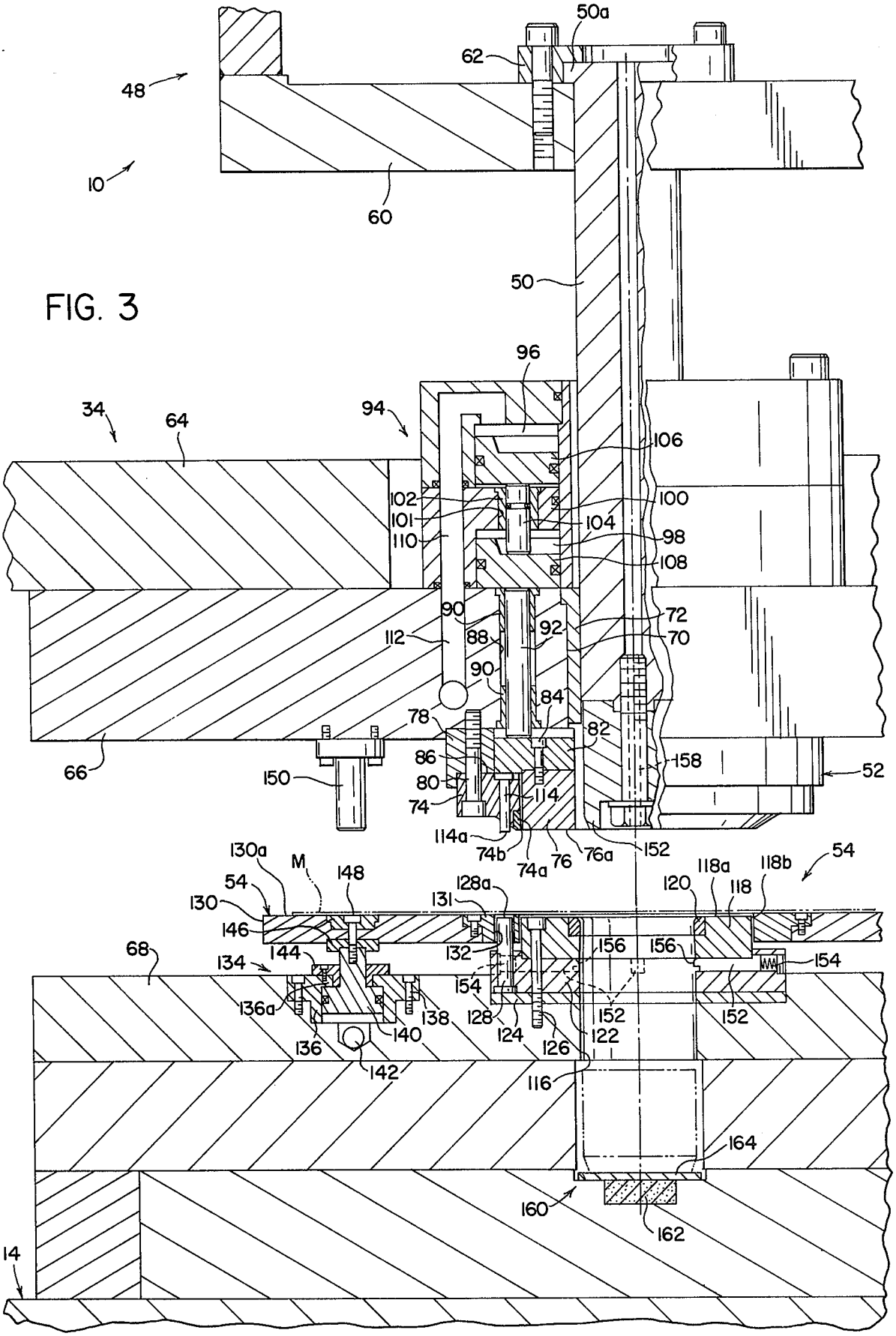
FIG. 3 is a sectional elevation view showing details of a tool assembly according to the present invention and showing the component parts in the positions thereof prior to a cutting and drawing operation; and, FIG. 4 is a sectional elevation view similar to FIG. 3 and showing the component parts in their respective positions following a cutting and drawing operation.
Figure 4:
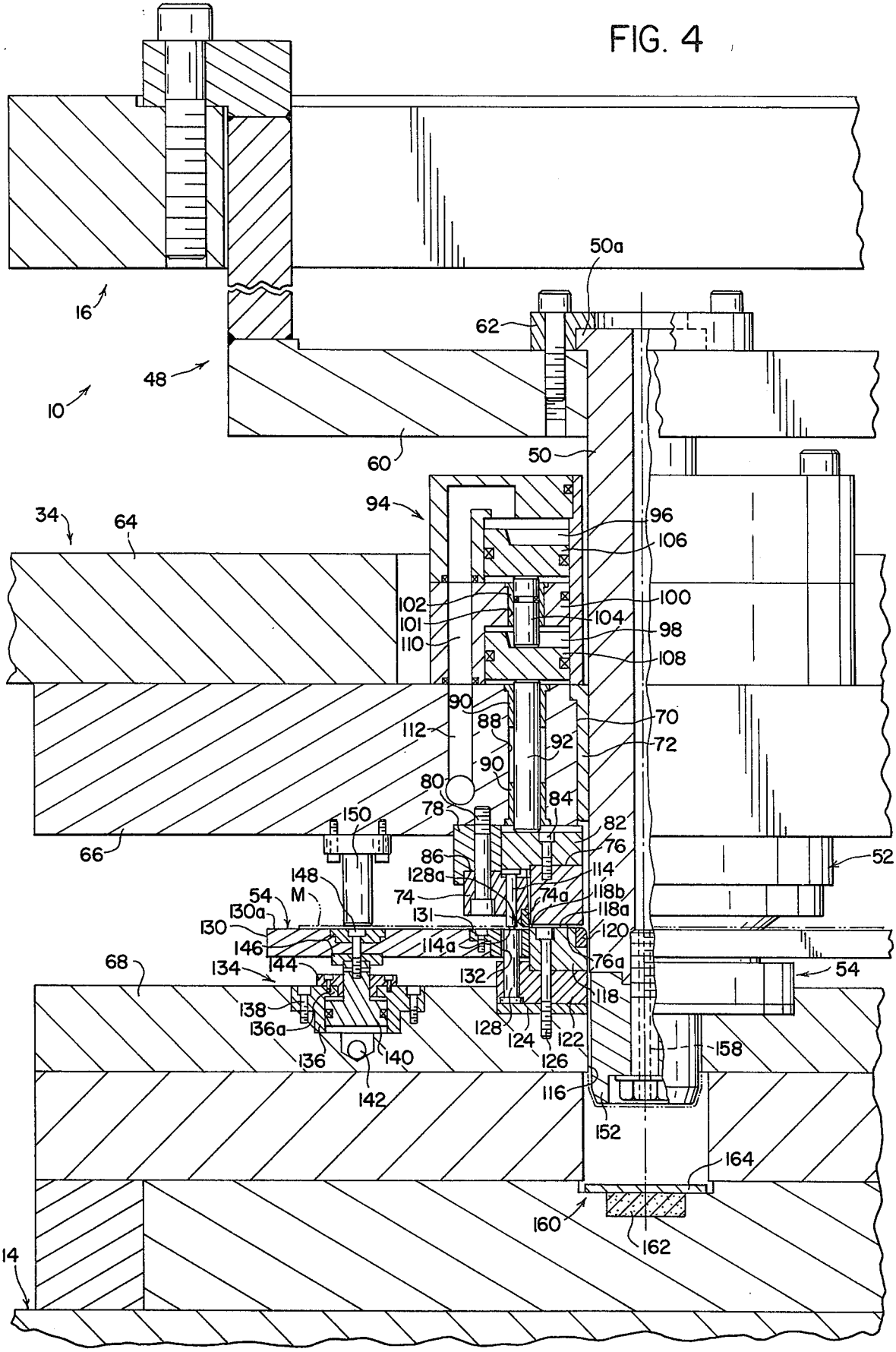

The structures and cooperative interrelationships between a punch 50 and the corresponding blank cutting and holding assemblies 52 and 54 are shown in detail in FIGS. 3 and 4. FIG. 3 shows punch 50 and assemblies 52 and 54 in the positions thereof prior to a cutting and drawing operation, and FIG. 4 shows the punch and assemblies in the positions thereof following a cutting and drawing operation. With reference to the latter Figures, it will be seen that punch mounting bracket 48 on punch slide 10 includes a punch mounting plate 60 apertured to receive the upper end of punch 50. The upper end of the punch is provided with a radial flange 50*a* which engages the upper surface of mounting plate 60, and the punch is removably retained on the mounting plate by means of a clamp member 62 which is bolted to the mounting plate.

Upper blanking slide frame 34 includes a horizontal frame portion 64 to the underside of which is attached a mounting plate 66. Blank cutting and holding assembly 52 is mounted on plate 66 as described in detail hereinafter. A die shoe plate 68 is mounted on bolster plate 14 and carries the lower blank cutting and holding assembly 54 as described in detail hereinafter. Punch 50 extends downwardly through an opening 70 in mounting plate 66, and a punch guide bushing 72 is interposed between the punch and opening 70 to slidably receive and guide the punch.

Upper blank cutting and holding assembly 52 is an annular assembly surrounding punch 50 and includes an annular cutter member 75 attached to mounting plate 66 for movement therewith and against movement relative thereto. Assembly 52 further includes an annular draw pad member 76 which is movable with mounting plate 66 and is vertically reciprocable relative thereto. Cutter member 74 includes a cutter blade 74*a* at the lower inner edge of the opening therethrough, and draw pad 76 is an annular ring having an outer periphery radially adjacent cutting edge 74*b* of blade 74*a*. Cutter member 74 is spaced from mounting plate 66 by means of an annular mounting ring 78 and is rigidly fastened to plate 66 by a plurality of circumferentially spaced studs 80, only one of which is shown. Draw pad 76 is attached to an annular draw pad retainer ring 82 by means of a plurality of studs 84. Retainer ring 82 has an outer periphery slidably engaging the inner periphery of mounting ring 78 and, as seen in FIG. 3, is normally spaced below mounting plate 66. Accordingly, ring 82 and thus draw pad 76 are reciprocable relative to cutter member 74 and mounting plate 66. Cutter member 74 has a top surface 86 engaged by the underside of draw pad retainer 82 to limit downward movement of the draw pad relative to the cutter member. Further, draw pad retainer 82 is biased downwardly toward surface 86, as described hereinafter, whereby upward movement of draw pad 76 relative to cutter member 74 is against the biasing force.

More particularly with regard to the downward bias against draw pad 76, mounting plate 66 is provided with four openings 88 equally spaced apart circumferentially of plate 66 and overlying draw pad retainer ring 82. While only one such opening is shown it will be appreciated that each opening overlies retainer ring 82 and is provided with a bearing sleeve 90 slidably receiving a corresponding lower draw pin 92. An annular housing 94 is mounted on top of mounting plate 66 and provides upper and lower annular cylinder chambers 96 and 98, respectively, which are vertically spaced apart and coaxial with punch 50. Housing 94 includes a wall 100 between chambers 96 and 98, and wall 100 is provided with openings 101 corresponding in number and axially aligned with openings 88 in plate 66. Each opening 101 is provided with a corresponding bushing 102 slidably receiving a corresponding upper draw pin 104. An annular piston 106 is slidably received in chamber 96, and an annular piston 108 is slidably received in chamber 98. Draw pins 104 engage the opposed end faces of the pistons, and the upper ends of lower draw pins 92 engage the underside of piston 108. Pistons 106 and 108 are biased downwardly by air under pressure introduced into chamber 96 through a passageway 110 in housing 94 which communicates with a passageway 112 in mounting plate 66. The latter passageway is connected to a suitable source of air under pressure, not shown.

It will be appreciated from the foregoing description that upward movement of die pad member 76 relative to cutter member 74 is against the bias of air under pressure acting against piston 106. A plurality of upper standoff pins 114 extend through corresponding openings in cutter member 74 and are vertically reciprocable relative thereto. Pins 114 correspond in number and circumferential location with draw pins 92. Accordingly, although only one pin 114 is shown it will be appreciated that four pins are provided in assembly 52. The upper ends of pins 114 are headed to engage the underside of draw pad retainer ring 82 and to limit downward movement of the pins relative to cutter member 74. Draw pad 76 has a drawing surface 76*a*, and pins 114 have lower faces 114*a*. Drawing surface 76*a* and lower faces 114*a* have a particular interrelationship as set forth more fully hereinafter.

With regard now to lower blank cutting and holding assembly 54, die shoe plate 68 has an opening 116 therethrough to receive the lower end of punch 50 during reciprocation of the punch slide. Assembly 54 is an annular assembly surrounding and coaxial with opening 116 and includes an annular draw plate 118 carrying a die ring 120 at the upper inner edge of the opening therethrough. Draw plate 118 rests on a support ring 122 disposed in a recess in the upper side of die shoe 68, and ring 122 overlies an annular grind plate 124 disposed in the recess. Draw plate 118 is fastened to die shoe 68 by means of a plurality of circumferentially spaced studs 126, only one of which is shown, and the draw plate has an upper drawing surface **118*a* which is opposed and parallel to drawing surface 76*a* of draw pad member 76. Ring member 122 is provided with a plurality of openings receiving lower standoff pins 128 corresponding in number and axially aligned with upper standoff pins 114. The lower ends of pins 128 have heads received in corresponding recesses in the underside of ring member 122 whereby the pins are axially clamped against grind plate 124. The upper ends of pins 128 have faces 128*a*, and drawing surface 118*a* and faces 128*a*** have an interrelationship set forth more fully hereinafter.

As shown in FIGS. 1 and 2, a single stock support plate 130 overlies die shoe plate 68 of the press and is common to all of the punches 50 and corresponding cutting and holding assemblies 52 and 54. Plate 130 is open at each punch location and provided with a collar 131 surrounding draw plate 118. Collar 131 is provided with a plurality of openings 132 receiving the upper ends of standoff pins 128. Plate 130 supports a metal sheet M to be blanked and drawn, as set forth more fully hereinafter, and has an upper surface **130*a* normally spaced slightly above drawing surface 118*a* of draw plate 118. Stock support plate 130 is adapted to reciprocate vertically against a pneumatic bias which normally positions upper surface 130*a* of the plate in the foregoing relationship with respect to drawing surface 118*a*, as shown in FIG. 3. More particularly, dash pot units 134, one of which is seen in FIGS. 3 and 4, are mounted in die shoe 68 beneath and adjacent the periphery of plate 130. Each dash pot unit includes a piston housing 136 attached to plate 68 by means of a plurality of studs 138. A piston member 140 is disposed within housing 136, and the underside of the piston is exposed to air under pressure through a passageway 142 which is connected to a suitable source of pressurized air, not shown. The upper end of piston 140 extends through a bushing 144 and is attached to stock plate 130 by means of a pair of stock plate washers 146 and a stud 148. Mounting plate 66 is provided with pins 150 each axially opposed to a corresponding dash pot unit. It will be appreciated that upon downward movement of mounting plate 66 pin 150 engages metal sheet M and displaces stock plate 130 downwardly against the bias provided by the dash pot unit. Upon upward movement of plate 66, the dash pot unit operates to return the stock plate to its uppermost position. Upward movment of the stock plate is limited by engagement of the upper side of piston 140 with the radially inwardly extending flange 136*a* of housing 136**.

Prior to movement of slides 10 and 12 of the press to achieve a blank cutting, holding and drawing operation, the component parts of the tool assembly are in the positions shown in FIG. 3. While so positioned, metal sheet M is introduced onto stock plate 130 and positioned between upper cutting and holding assembly 52 and lower cutting and holding assembly 54. Rotation of press crankshaft 26 causes blanking slide 12 to descend, thus displacing mounting plate 66 and upper blank cutting and holding assembly 52 downwardly toward die shoe 68. During such downward movement of mounting plate 66, the upper side of metal sheet M is engaged by pins 150, draw pad 76 and upper standoff pins 114, thus displacing stock plate 130 and sheet M downwardly relative to draw plate 118 and lower standoff pins 128. When sheet M engages the fixed lower standoff pins 128, downward movement of upper standoff pins 114 and thus draw pad 76 is stopped. During the ensuing downward movement of mounting plate 66, cutter member 74 moves therewith and relative to standoff pins 114 and draw pad 76, whereby cutting edge **74*b* of blade 74*a* and cutting edge 118*b* of drawing plate 118** cooperatively sever a circular blank from metal sheet M.

During downward movement of cutter member 74 to sever a blank from sheet M, the positions of pistons 106 and 108 and draw pins 92 and 104 are fixed through the fixed positional relationship of upper standoff pins 114 and draw pad retainer ring 82 relative to lower standoff pins 128. Therefore, housing 94 moves downwardly with mounting plate 66 and relative to pistons 106 and 108 against the air pressure in chamber 96. Since draw pad 76 is mounted on the draw pad retainer ring 82 it will be appreciated that the draw pad position is likewise fixed with respect to draw plate 118 and that upward displacement of draw pad 76 relative to mounting plate 66 is opposed by the air pressure bias. It will be further appreciated that since standoff pins 114 and 128 engage opposite sides of sheet M, the spacing between draw plate 118 and draw pad 76 is determined by the thickness of sheet M. Thus, the spacing between opposed drawing surfaces **76*a* and 118*a*** will vary in accordance with changes in the thickness of sheet M and thus provide optimum holding pressure for the cut blank during the drawing operation. Advantageously, the draw surface spacing is completely independent of the cutter member, whereby the biasing pressure need function only to provide the desired holding pressure during drawing. Additionally, as a result of the independent cutting an holding, vibrations, cutting forces and the like encountered during the cutting operation are not transmitted to the components which serve to provide the spacing and holding force for the cut blank.

Following the cutting operation and engagement of the blank between drawing surfaces **76*a* and 118*a*, the lower end of punch 50 engages the blank and displaces the latter axially through die ring 120 to draw the blank to a cup-shaped configuration. Blank cutting and holding assembly 54 further includes a plurality of stripper fingers 152 positioned beneath draw plate 118 in corresponding recesses provided in retainer ring 122. Stripper fingers 152 are biased radially inwardly of opening 116 in die shoe 68 by corresponding springs 154 and are provided on their inner ends with noses 156. When the open upper end of the drawn cup-shaped blank passes the stripper finger noses, the figures engage behind the drawn blank so that the subsequent upward movement of punch 50** causes the cup-shaped blank to be stripped from the end of the punch.

To facilitate the stripping function and displacement of the cup-shaped blanks downwardly through opening 116 in die shoe 68, punch 50 is provided with a passageway 158 through which air under pressure can be introduced to push the cup-shaped blank downwardly relative to the punch. The formed blank then falls onto a corresponding magnetic pad unit 160 mounted in bolster plate 14 in axial alignment with the punch. Magnetic pad unit 160 includes a suitable magnet member 162 and a magnet cover 164 which is engaged by the closed bottom end of the formed blank. The blank is then displaced from between bolster 14 and die shoe 68 by a suitable transfer device, not shown.

Following the drawing operation, the crankshaft of the press operates to raise punch slide 10 and thus punch 50 toward the initial position thereof shown in FIG. 3, and to elevate blanking slide 12 and thus blank cutting and holding assembly 52 to its initial position. During the latter movement, air under pressure in cylinder 96 biases draw pad 76 and upper standoff pins 114 downwardly relative to mounting plate 66, and dash pot 134 biases stock support plate 130 upwardly relative to lower standoff pins 128 and draw plate 118. Such movement of the stock support plate elevated metal sheet M to a plane above the planes of drawing surface 118 and standoff pin surface 128*a* to provide the necessary clearance for displacement of sheet M to position an uncut portion thereof relative to the upper and lower assemblies 52 and 54 for the next blank cutting, holding and punching operation.

While considerable emphasis has been placed herein on a specific embodiment of the present invention and upon the specific structure of the component parts of the embodiment disclosed, it will be appreciated that many changes can be made and will be obvious to those skilled in the art upon reading and understanding the foregoing descriptive matter. Accordingly, it is to be distinctly understoo that the description herein is to be interpreted merely as illustrative of the present invention and not as a limitation.

What is claimed is:

1. Apparatus for forming an article from a sheet having a thickness comprising, first support means, first cutter means fixed on said first support means against movement relative thereto, draw pad means separate from said first cutter means and mounted on said first support means for reciprocating movement relative thereto and to said first cutter means, second support means, die means and second cutter means on said second support means, said first and second cutter means being opposed and cooperable to sever a blank from said sheet, said draw pad means and die means having opposed drawing surfaces respectively engaging opposite sides of said blank, ram means cooperable with said die means to draw said blank to a drawn shape, means for causing relative reciprocation between said first and second support means and said ram means, said blank having a peripheral edge, and said second support means and said draw pad means including opposed pin means engaging opposite sides of said sheet outwardly of said peripheral edge of said blank to maintain said drawing surfaces spaced apart during said drawing of said blank a distance determined by the thickness of said sheet.

2. Apparatus according to claim 1, wherein said means to maintain said drawing surfaces spaced apart includes means biasing said draw pad means toward said die means.

3. Apparatus according to claim 1, wherein said second support means and said die means and second cutter means thereon are positionally fixed and said first support means and ram means are reciprocable relative to one another and to said second support means.

4. Apparatus according to claim 3, wherein said die means, draw pad means and said first and second cutter means are annular, said ram means being circular, said die means and draw pad means having aligned openings therethrough to receive said ram means, said first and second cutter means cutting a circular blank from said sheet, and said means to maintain said drawing surfaces spaced apart including opposed stop means on said draw pad means and second support means respectively engaging opposite sides of said sheet radially outwardly of said blank.

5. Apparatus according to claim 4, wherein said stop means are circumferentially spaced apart pairs of opposed pins.

6. Apparatus for forming an article from a sheet having a thickness comprising, reciprocable first support means, first annular cutter means fixed on said first support means against movement relative thereto, annular draw pad means separate from said first cutter means and mounted on said first support means for reciprocating movement relative thereto and to said first cutter means, fixed second support means, annular die means and annular second cutter means on said second support means, said first and second cutter means being opposed and cooperable to sever a circular blank from said sheet, said draw pad means and die means having opposed drawing surfaces respectively engaging opposite sides of said blank, circular ram means reciprocable relative to said first and second support means, said die means and draw pad means having aligned openings therethrough to receive said ram means, said ram means being cooperable with said die means to draw said blank to a drawn shape, means for causing relative reciprocation between said first and second support means and said ram means, means including opposed stop means on said second support means and said draw pad means respectively engaging opposite sides of said sheet radially outwardly of said blank to maintain said drawing surfaces spaced apart during said drawing of said blank a distance determined by the thickness of said sheet, said means to maintain said drawing surfaces spaced apart further including fluid biased piston means carried by said first support means and acting against said draw pad means to bias said draw pad means toward said die means.

7. Apparatus according to claim 6, wherein said stop means includes pins on said draw pad means to engage the corresponding side of said sheet and limit movement of said draw pad means with said first support means in the direction toward said die means and to cause movement of said draw pad means relative to said first support means against the bias of said piston means.

8. Apparatus for forming an article from a sheet having a thickness comprising, first support means, second support means reciprocable relative to said first support means between a first position spaced from said first support means and a second position closer to said first support means, means on said first support means providing an annular drawing die, a first drawing surface extending radially therefrom and an annular cutting edge, an annular draw pad on said second support means having a second drawing surface facing said first drawing surface, means mounting said draw pad on said second support means for movement therewith and for reciprocating movement relative thereto in the direction between said first and second drawing surfaces, means biasing said draw pad toward said first drawing surface, an annular cutter fixed on said second support means against movement relative thereto, said cutter being cooperable with said cutting edge to sever a blank from said sheet during movement of said second support means from said first to said second position, said first and second drawing surfaces respectively engaging opposite sides of said blank, a ram cooperable with said drawing die to form said blank to a drawn shape, means to reciprocate said ram and second support means relative to said first support means, and means to maintain said first and second drawing surfaces spaced apart a fixed distance during forming said blank, said last named means including means interconnected with said draw pad to engage the corresponding side of said sheet and stop movement of said draw pad with said second support means before said second support means reaches said second position.

9. Apparatus according to claim 8, wherein said means interconnected with said draw pad is a plurality of circumferentially spaced apart pins positioned radially outwardly of said cutting edge.

10. Apparatus according to claim 9, wherein said last named means further includes a corresponding plurality of pins on said first support member positioned opposite said pins interconnected with said draw pad.

11. Apparatus according to claim 10, wherein said means biasing said draw pad includes pneumatic piston and cylinder means including cylinder means mounted on said second support means for movement therewith and piston means in said cylinder means and interconnected with said draw pad.

12. Apparatus according to claim 8, wherein said means biasing said draw pad includes pneumatic piston and cylinder means including cylinder means mounted on said second support means for movement therewith and piston means in said cylinder means and interconnected with said draw pad.

13. Apparatus according to claim 8, wherein said second support means is vertically above said first support means, said means to reciprocate said ram and second support means including a crankshaft below said first support means and cam and follower means interconnecting said crankshaft and said second support means.

14. Apparatus according to claim 13, wherein said means to reciprocate said ram and second support means further includes third support means reciprocable relative to said first and second support means, said ram being mounted on said third support means, and connecting rod means interconnecting said crankshaft and third support means.

15. Apparatus according to claim 14, wherein said means interconnected with said draw pad is a plurality of circumferentially spaced apart pins positioned radially outwardly of said cutting edge.

16. Apparatus according to claim 15, wherein said last named means further includes a corresponding plurality of pins on said first support member positioned opposite said pins interconnected with said draw pad.

17. Apparatus according to claim 16, wherein said means biasing said draw pad includes pneumatic piston and cylinder means including cylinder means mounted on said second support means for movement therewith and piston means in said cylinder means and interconnected with said draw pad.

* * * * *